US007688266B2

(12) United States Patent
Akiyama et al.

(10) Patent No.: US 7,688,266 B2
(45) Date of Patent: Mar. 30, 2010

(54) ANTENNA MODULE

(75) Inventors: Kiyokazu Akiyama, Okazaki (JP); Yuji Sugimoto, Kariya (JP); Taizo Mizutani, Nagoya (JP)

(73) Assignee: Denso Corporation, Kariya (JP)

( * ) Notice: Subject to any disclaimer, the term of this patent is extended or adjusted under 35 U.S.C. 154(b) by 204 days.

(21) Appl. No.: 12/080,265

(22) Filed: Apr. 1, 2008

(65) Prior Publication Data

US 2008/0284658 A1 Nov. 20, 2008

(30) Foreign Application Priority Data

Apr. 3, 2007 (JP) ..... 2007-097455

(51) Int. Cl.
*H01Q 1/38* (2006.01)
*H01Q 1/48* (2006.01)

(52) U.S. Cl. ..... 343/700 MS; 343/846; 343/829

(58) Field of Classification Search ..... None
See application file for complete search history.

(56) References Cited

U.S. PATENT DOCUMENTS

| | | | | |
|---|---|---|---|---|
| 6,369,762 | B1 | 4/2002 | Yanagisawa et al. | |
| 6,624,790 | B1 | 9/2003 | Wong et al. | |
| 7,081,859 | B2 | 7/2006 | Miyoshi et al. | |
| 7,271,777 | B2 | 9/2007 | Yuanzhu | |
| 2005/0248487 | A1 * | 11/2005 | Okado | 343/700 MS |
| 2007/0210965 | A1 * | 9/2007 | Takada et al. | 343/700 MS |
| 2007/0229367 | A1 * | 10/2007 | Fukui et al. | 343/700 MS |
| 2007/0290926 | A1 * | 12/2007 | Tseng | 343/700 MS |
| 2008/0018539 | A1 * | 1/2008 | Jung et al. | 343/700 MS |

FOREIGN PATENT DOCUMENTS

| | | |
|---|---|---|
| JP | 57-142003 | 9/1982 |
| JP | 9-246681 | 9/1997 |
| JP | 2000-196344 | 7/2000 |
| JP | 2001-119232 | 4/2001 |
| JP | 2004-129209 | 4/2004 |
| JP | 2005-094437 | 4/2005 |
| JP | 2006-14154 | 1/2006 |
| JP | 2006-174365 | 6/2006 |
| JP | 2006-345038 | 12/2006 |
| JP | 2007-043582 | 2/2007 |

OTHER PUBLICATIONS

Office action dated Mar. 23, 2009 in Japanese Application No. 2007-097455.
Office action dated Jun. 16, 2009 in Japanese Application No. 2007-097455.
Office action dated Sep. 8, 2009 in corresponding Japanese Application No. 2007-097455.

* cited by examiner

*Primary Examiner*—Trinh V Dinh
(74) *Attorney, Agent, or Firm*—Harness, Dickey & Pierce, PLC

(57) ABSTRACT

An antenna module includes a substrate; a ground element disposed on the substrate; a first antenna element disposed on the substrate; and a second antenna element disposed on the substrate. The first antenna element and the second antenna element are, respectively, capable of transmitting radio waves having a first polarization direction and a second polarization direction unparallel to each other. A spacing between a perimeter of the ground element and the first antenna element increases as a function of increasing distance from the second antenna element. A spacing between the perimeter of the ground element and the second antenna element increases as a function of increasing distance from the first antenna element.

10 Claims, 4 Drawing Sheets

ANTENNA MODULE

CROSS REFERENCE TO RELATED APPLICATION

The present application is based on Japanese Patent Application No. 2007-97455 filed on Apr. 3, 2007, the disclosure of which is incorporated herein by reference.

FIELD OF THE INVENTION

The present invention relates to an antenna module including a substrate, a ground element disposed on the substrate, and an antenna element disposed on the substrate.

BACKGROUND ELEMENT OF THE INVENTION

An antenna module, which has a ground element disposed on a substrate and an antenna element disposed on the substrate, is disclosed in, for example, Japanese Unexamined Patent Application Publication Number 2006-345038. However, antenna modules like the above one, which are capable of providing polarization diversities, have not been known.

When two antenna modules having an identical characteristic are arranged in different directions, it may be possible to provide the antenna modules realizing a polarization diversity. In the above case, however, since each of the two antenna modules is required to have a ground element therefor, whole size of the antenna modules may increase.

For the above reason, an antenna module capable of realizing a polarization diversity with using multiple antenna elements is required. Also, it is required to downsize such an antenna module.

SUMMARY OF THE INVENTION

In view of the above-described problem, it is an object of the present disclosure to provide an antenna module realizing a polarization diversity.

According to an aspect of the present disclosure, an antenna module includes: a substrate; a ground element disposed on the substrate; a first antenna element disposed on the substrate and configured to transmit a radio wave having a first polarization direction; a second antenna element disposed on the substrate and configured to transmit a radio wave having a second polarization direction; a first feeding point disposed in the first antenna element on a ground element side; and a second feeding point disposed in the second antenna element on a ground element side. The first polarization direction is nonparallel to the second polarization direction. The ground element is configured so that: a spacing between a perimeter of the ground element and the first antenna element has a minimum located proximal to the first feeding point; and the spacing increases as a function of increasing distance from the second antenna element. The ground element is configured so that: a spacing between the perimeter of the ground element and the second antenna element has a minimum located proximal to the second feeding point; and the spacing increases as a function of increasing distance from the first antenna element.

According to the above configuration, since the first polarization direction and the second polarization direction are unparallel to each other, it is possible to realize a polarization diversity with using the first and second antenna elements disposed on the substrate. Moreover, since the first and second antenna elements share the ground, it is possible to restrict an increase in a size of the antenna module.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1:
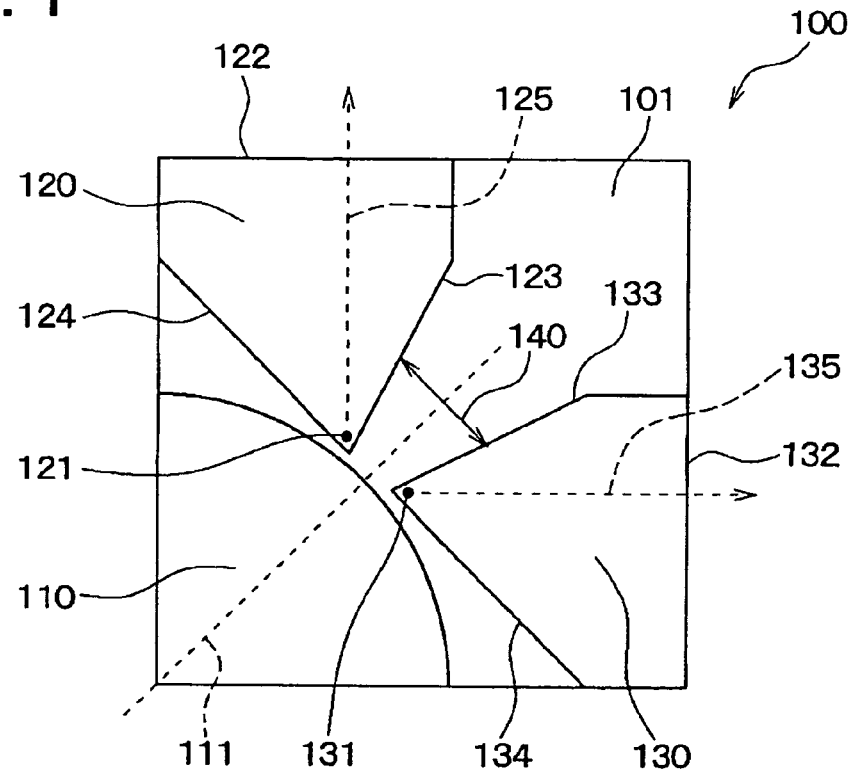
FIG. 1 is a schematic plan view illustrating an antenna module according to a first embodiment.

An explanation on a first embodiment according to the present invention is given below with reference to FIG. 1. FIG. 1 illustrates a plan view of an antenna module 100 according to the first embodiment. As shown in the FIG. 1, the antenna module 100 includes a substrate 101 provided by a dielectric body, a ground element 110 provided by a conductor pattern, an antenna element 120 provided by a conductor pattern, and an antenna element 130 provided by a conductor pattern. The ground element 110 is a pattern disposed on a corner of the substrate 101. The ground element 110 has a quartered disk shape, that is, a 90-degree circular sector shape. Thus, a perimeter of the ground element 110 consists of a circular arc and two radii. The central angle of the circular arc is 90 degrees, and each of the two radii connects the center of the circular arc and an end of the circular arc.

The antenna element 120 is a pattern disposed on the substrate 101 so as to be adjacent to the circular arc of the ground element 110. In FIG. 1, the antenna element 120 is located at the upper left side. The antenna element 120 transmits and/or receives radio waves whose polarization plane is parallel to a vertical direction corresponding to a up-down direction of the FIG. 1. That is, the antenna element 120 transmits and/or receives vertically-polarized radio waves. As shown in FIG. 1, a perimeter of the antenna element 120 has a pentagonal shape, which appears similar to a home plate used in base ball.

A feeding point 121 is disposed in a vertex portion of the pentagonal shape, the vertex portion being located closest to the ground element 110 than other vertex portions of the pentagonal shape. That is, the feeding point 121 is disposed in an edge portion of the antenna element 120, the edge portion being located adjacent to the ground element.

According to the above, when a current is supplied from a signal circuit, which is not shown, to the feeding point 121 via a coaxial wire or a microstrip wire, a current flows from the feeding point 121 along a direction to a bottom side 122, which is a side located most distant from the feeding point 121; thereby, the antenna element 120 transmits and/or receives vertically-polarized waves. In this manner, the antenna element 120 functions as a monopole antenna, and thus can transmit and/or receive radio waves having wavelengths less than or equal to a wavelength $\lambda$ that is $4/\alpha$ multiplied by a distance between the bottom side 122 and a vertex around which the feeding point 121 is disposed. Here, the factor $\alpha$ is a wave-length fractional shortening ratio, which is caused by a presence of the dielectric body in the substrate 101. In other words, when a polarization direction is defined as a direction parallel to the polarization plane associated with the antenna element 120, a length in the polarization direction is $\alpha/4$ multiplied by the wave length $\lambda$. The wave length $\lambda$ corresponds to a lower-limit frequency of an usable bandwidth of the antenna module 100.

Also, two sides 123 and 124, each of which extends from the vertex portion where the feeding point 121 is disposed, have a spacing therebetween, the spacing increasing in a direction away form the feeding point 121. Accordingly, the antenna element has a tapered portion between the side 123 and the side 124 (corresponding to an example of a first tapered portion). A width of the tapered portion, which is measured in a direction perpendicular to the polarization direction associated with the antenna element 120 (corresponding to a first polarization direction), increases with increasing distance from the feeding point 121 in the polarization direction.

Moreover, a width of the antenna element 120 in a direction perpendicular to the polarization direction is constant from ends of the tapered portion to the bottom side 122, the ends being opposite to the feeding point 121. In this manner, a maximum width of the antenna element 120 in the direction perpendicular to the polarization direction is equal to a length of the bottom side 122 (the maximum width is simply refereed to hereinafter as a width of the antenna element 120). As is well known, in a monopole type element, as a width thereof increases, a usable frequency bandwidth broadens. In an example in FIG. 1, the width of the antenna element 120 is $\alpha\lambda/4$. This configuration enables to broaden a bandwidth of the antenna element 130.

The antenna element 130 is a pattern disposed on the substrate 101 so as to be adjacent to the circular arc of the ground element 110. In FIG. 1, the antenna element 130 is located at lower-right side. The antenna element 130 transmits and/or receives radio waves whose polarization plane is parallel to a horizontal direction (cf., right to left direction in the page). That is, the antenna element 130 transmits and/or receives horizontally-polarized waves. As shown in FIG. 1, the antenna element 130 has a pentagonal shape appearing similar to a home plate used in base ball.

A feeding point 131 is disposed in a vertex portion of the pentagonal shape, which is closest to the ground element 110 than other vertexes of the pentagonal shape (that is, the feeding point 131 is disposed in an edge portion of the antenna element 130 located adjacent to the ground element 110).

According to the above configuration, when a current is supplied from a signal circuit, which is not shown, to the feeding point 131 via a coaxial wire or a microstrip wire, a current flows from the feeding point 131 along direction to a bottom side 132, which is the most distant side from the feeding point 131. Thereby, the antenna element 130 can transmit and/or receive horizontally-polarized radio waves. In this manner, the antenna element 130 functions as a monopole type antenna element, and thus can transmit and receive radio waves having wave lengths less than or equal to a wavelength $\lambda$ that is $4/\alpha$ multiplied by a distance between the bottom side 132 and the vertex around which the feeding point 131 is located. In other words, a length in a polarization direction associated with the antenna element 130 (corresponding to an example of a second polarization direction) is $\alpha/4$ multiplied by the wave length B. The wave length $\lambda$ corresponds to the lower-limit frequency of the usable bandwidth of the antenna module 100.

Also, two sides 133 and 134, each of which extends from the vertex where the feeding point 131 is located, have a spacing therebetween, the spacing increasing in a direction away from the feeding point 131. Accordingly, a portion of the antenna element 130 located between the side 133 and the side 134 is a tapered portion (corresponding to a second tapered portion). A width of the tapered portion, which is measured in a direction perpendicular to the polarization direction associated with the antenna element 130, increases as a function of increasing distance from the feeding point 131 in the polarization direction.

In addition, a width of the antenna element 130 in a direction perpendicular to the polarization direction associated with the antenna element 130 is constant from the bottom side 132 to ends of the tapered portion, the ends being opposite to the feeding point 131. In this manner, a maximum width of the antenna element 130 in a direction perpendicular to the polarization direction associated with the antenna element 130 (simply referred to hereinafter as a width of the antenna element 130) is equal to a length of the bottom side 132. In an example shown in FIG. 1, the width of the antenna element 130 is $\alpha\lambda/4$. The above configuration enables to broaden a bandwidth of the antenna element 130.

In addition, the tapered portion is asymmetric with respect to a line 135 extending from the feeding point 131 in the polarization direction. More specifically, with respect to the polarization direction line 135, an area of a portion of the antenna element 130 located closer to the antenna element 120 is smaller than an area of the other portion of the antenna element 130 located more distant from the antenna element 120 than the polarization direction line 135.

According to the above, the polarization directions associated with the antenna element 120 and the antenna element 130 are orthogonal with each other. Thus, it is possible to realize a polarization diversity with using the antenna elements 120, 130 disposed on the substrate 101. Moreover, the two antenna elements 120, 130 share the one ground element 110; accordingly, it is possible to reduce an increase in a size of the antenna module 100, which includes the antenna elements 120, 130.

Moreover, since the perimeter of the ground element 110 includes the circular arc, the spacing between the antenna element 120 and the ground element 110 increases along the circular arc in a direction away from the feeding point 121 as a function of increasing distance from the antenna element 130. Thus, the ground element 110 is shaped so that the ground element 110 curves so as to being away from a side of the antenna element 120, the side being opposite to the antenna element 130. This restricts a resonance of the antenna element 120 in an undesired polarization direction.

In a similar manner, since the perimeter of the ground element 110 has the circular arc, a spacing between the antenna element 130 and the ground element 110 increases along the circular arc in a direction away from the feeding point 131 as a function of increasing distance from the antenna element 120 in such a direction as to increase the spacing. Thus, the ground element 110 has such a shape that the ground element 110 curves so as to being away from a side of the antenna element 130, the side being opposite to the antenna element 120. This restricts a resonance of the antenna element 130 in a undesired polarization direction. As is described, the ground element 110 is configured to be a circular sector shape, which eliminates edge portions. Resonances in undesired directions are thus restricted.

Moreover, the shape of ground element 110 is line-symmetric with respect to a symmetry axis 111. Furthermore, the shape of the antenna element 120 and the shape of the antenna element 130 are line-symmetric to each other with respect to the symmetry axis 111. Furthermore, a position of the feeding point 121 and a position of the feeding point 131 are line-symmetric to each other with respect to the symmetry axis 111. Because of these configurations, an electric characteristic of the antenna element 120 and an electric characteristic of the antenna element 130 are identical for the ground element 110. Because of these configurations, it is possible to eliminate one factor that causes performance of one of the two antenna elements 120, 130 to be inferior to performance of the other.

Moreover, since each of the two antenna elements 120, 130 includes the tapered portion having the vertex portion where the feeding point 121, 131 is disposed, it is possible to form the ground element 110 to have such a shape that the ground element curves so as to being away from the antenna elements 120, 130. Furthermore, since it is possible to wide a spacing between the two antenna elements 120, 130, a possibility that the two antenna elements 120, 130 exert negative influence to each other reduces.

Regarding the taper, more specifically, a spacing between the tapered portion of the antenna element 120 and the tapered portion of the antenna element 130 increases in a direction away form the ground element 110. This configuration further reduces a possibility that the two antenna elements 120, 130 exert negative influence to each other.

Here, large widths of the antenna elements 120, 130 contribute to boarding a bandwidth. However, when the spacing between the antenna element 120 and the antenna element 130 is configured to be narrow, both the elements 120, 130 may be electrically coupled with each other, which reduces performance of the diversity.

For this reason, the tapered portion of the antenna element 120 is asymmetric about line 125 extending from the feeding point 121 along the polarization direction associated with the antenna element 120. More specifically, with respect to the polarization direction line 125, the area of a portion of the antenna element 120 located closer to the antenna element 130 is smaller than the area of the other area of the antenna element 120 located more distant from the antenna element 130 than polarization direction line 125.

Similarly, the tapered portion of the antenna element 130 is asymmetric about line 135 extending from the feeding point 131 along the polarization direction associated with the antenna element 120. More specifically, with respect to the polarization direction line 135, the area of a portion of the antenna element 130 located closer to the antenna element 120 is smaller than the area of the other area of the antenna element 130 located more distant from the antenna element 120 than polarization direction line 135.

In this manner, it is possible to keep a sufficient width of the antenna element 120 while the asymmetry of the shapes of the antenna elements 120, 130 keeps a sufficient spacing 140 between the two antenna elements 120. Therefore, it is possible to suppress reduction of radiation performance of the antenna module 100 and it is possible to provide the antenna module 100 with a wide bandwidth.

Second Embodiment

Figure 2:
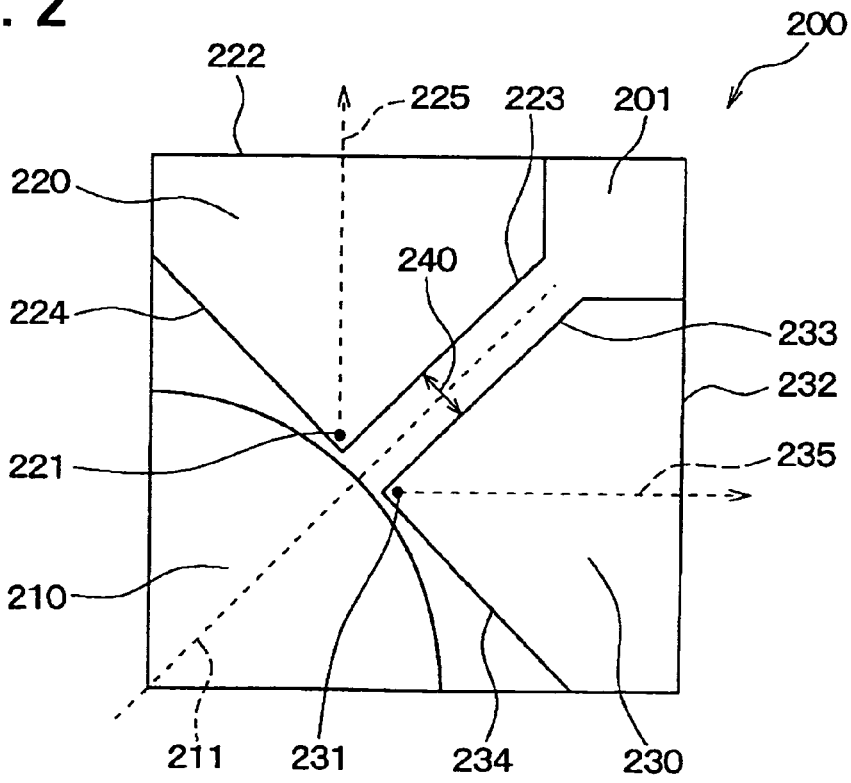
FIG. 2 is a schematic plan view illustrating an antenna module according to a second embodiment.

An explanation on a second embodiment is given below. FIG. 2 illustrates a plan view of an antenna module 200 according to the second embodiment. The antenna module 200, a substrate 201, a ground element 210, a symmetry axis 211, an antenna element 220, a feeding point 221, a bottom side 222, a taper portion side 223, a taper portion side 224, a polarization direction line 225, an antenna element 230, a feeding point 231, a bottom side 232, a taper portion side 233, a taper portion side 234, a polarization direction line 235, and a spacing 240 between elements according to the present embodiment, respectively, correspond to the antenna module 100, the substrate 101, the ground element 110, the symmetry axis 111, the antenna element 120, the feeding point 121, the bottom side 122, the taper portion side 123, the taper portion side 124, the polarization direction line 125, the antenna element 130, the feeding point 131, the bottom side 132, the taper portion side 133, the taper portion side 134, the polarization direction line 135, and the spacing 140 between the elements according to the first embodiment.

The antenna module 200 according to the present embodiment is different from the antenna module 100 according to the first embodiment in two points. A First point is that length of the bottom sides 222, 232 of the antenna elements 220, 230 according to the present embodiment are $\alpha\lambda/3$ although length of the bottom sides 122, 132 of the antenna elements 120, 130 according to the first embodiment are $\alpha\lambda/4$. A second point is that the antenna elements 220, 230 according to the present embodiment are symmetric with respect to the polarization direction lines 225, 235 although the antenna elements 120, 130 according to the first embodiment are asymmetric with respect to the polarization direction lines 125, 135.

In the above configuration, advantages according to the first embodiment are provided except advantages resulting from asymmetry of each of the two antenna elements. However, a broadening degree of a bandwidth is different from that according to the first embodiment.

Third Embodiment

Figure 3:
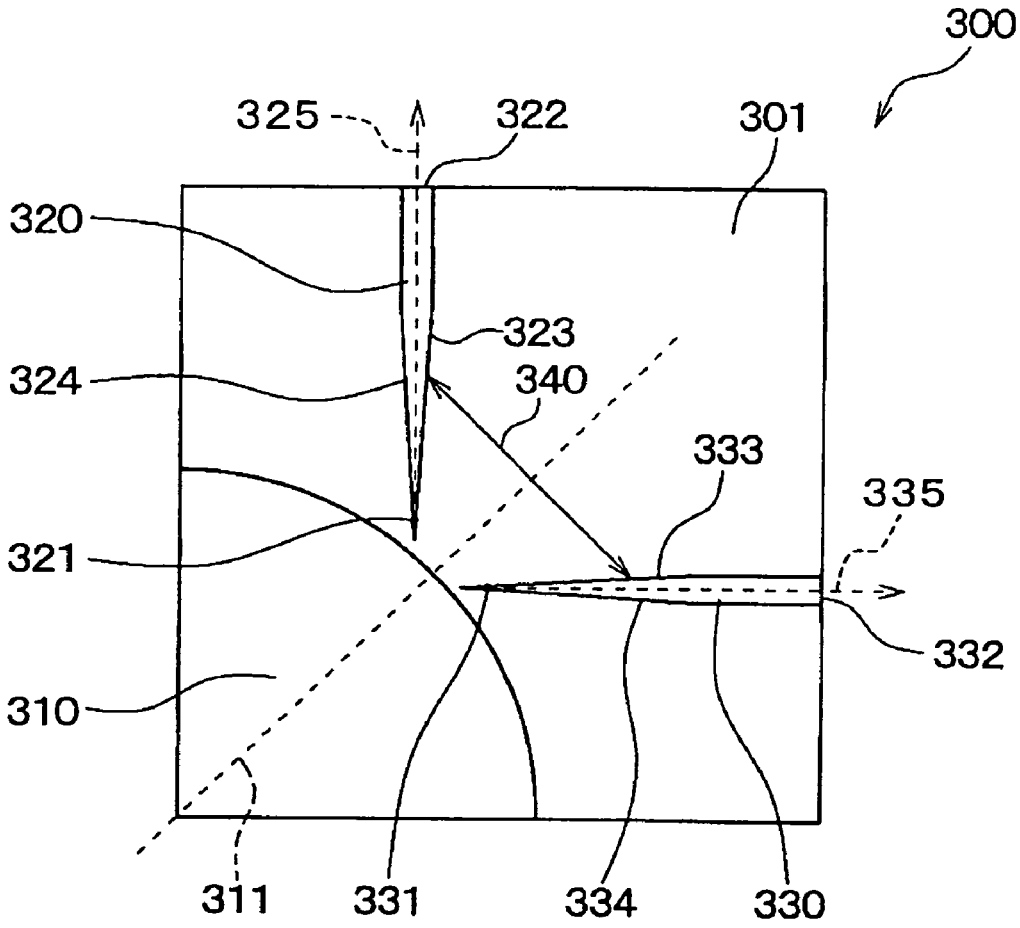
FIG. 3 is a schematic plan view illustrating an antenna module according to a third embodiment.

An explanation on a third embodiment is given below. FIG. 3 illustrates a plan view of an antenna module 300 according to the third embodiment. The antenna module 300, a substrate 301, a ground element 310, a symmetry axis 311, an antenna element 320, a feeding point 321, a bottom side 322, a taper portion side 323, a taper portion side 324, a polarization direction line 325, an antenna element 330, a feeding point 331, a bottom side 332, a taper portion side 333, a taper portion side 334, a polarization direction line 335, and a spacing 340 between elements according to the present embodiment, respectively, correspond to the antenna module 100, the substrate 101, the ground element 110, the symmetry axis 111, the antenna element 120, the feeding point 121, the bottom side 122, the taper portion side 123, the taper portion side 124, the polarization direction line 125, the antenna element 130, the feeding point 131, the bottom side 132, the taper portion side 133, the taper portion side 134, the polarization 135, and the spacing 140 between the elements.

The antenna module 300 according to the present embodiment is different from the antenna module 100 according to the first embodiment in two points. A first point is that widths of the bottom sides 322, 332 of the antenna elements 320, 330 according to the present embodiment are $\alpha\lambda/60$ although the bottom sides 122, 132 of the antenna elements 120, 130 according to the first embodiment are $\alpha\lambda/4$. A second point is that the antenna elements 320, 330 according to the present embodiment are symmetric with respect to the polarization direction lines 325, 335 although the antenna elements 120, 130 according to the first embodiment are asymmetric with respect to the polarization direction lines 125, 135.

In this configuration, advantages according to the first embodiment are provided except advantages resulting from asymmetry of each of the two antenna elements. However, a broadening degree of a bandwidth is different from that according to the first embodiment.

Figure 4:
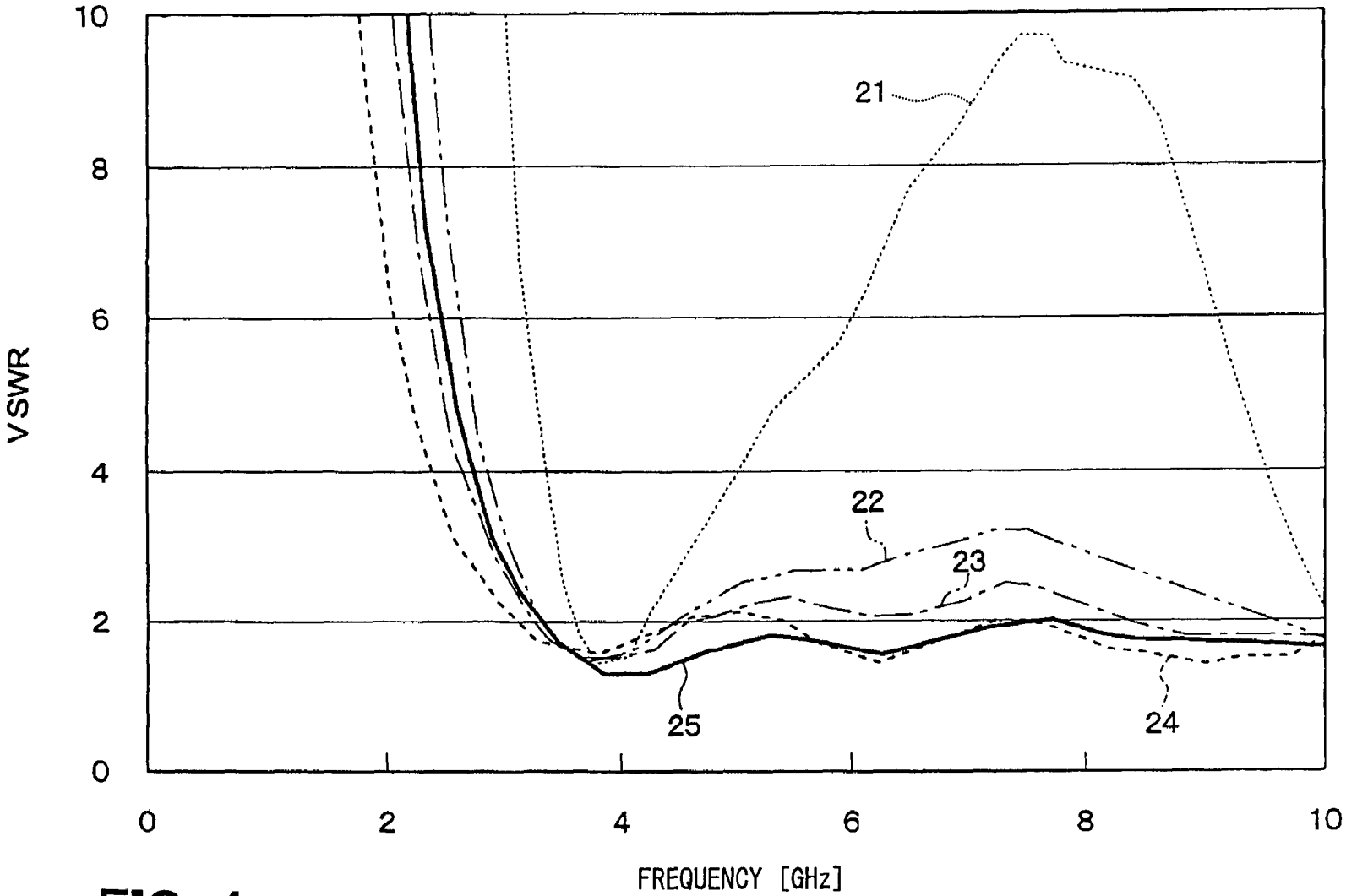
FIG. 4 is a graph showing a relation between voltage standing wave ratio (VSWR) and frequency of antenna modules according to the first to third embodiments.

A graph shown in FIG. 4 shows VSWR-frequency characteristics according to the first to third embodiments. In the graph, a line 21 expresses characteristics of the antenna module 300 according to the present embodiment. A line 22 expresses an antenna module for a case where widths of both antenna modules according to the second embodiment are changed into $\alpha\lambda/6$. A line 23 expresses an antenna module for a case where widths of both antenna modules according to the second embodiment are changed into $\alpha\lambda/4$. A line 24 expresses characteristics of the antenna module 200 according to the second embodiment. A line 25 expresses the antenna module 100 according to the first embodiment. Here, a vertical axis is VSWR (voltage standing wave ratio) and a horizontal axis is frequency (in GHz unit). A lower VSWR at a given frequency means that the antenna module at the given frequency performs well.

As shown by the line 25, the antenna module 100 according to the first embodiment has VSWRs less than or equal to 2 in an almost all frequencies in a band of between 4 GHz and 10 GHz. Also, as shown by the line 24, although the antenna module 200 according to the second embodiment has VSWRs greater than or equal to 2.5 at many frequencies in a band of between 4 GHz and 6 GHz, expect this band, the antenna module 200 according to the second embodiment has VSWRs less than or equal to 2 in almost all bands.

As described above, although the antenna elements of the antenna module 100 according to the first embodiment has narrower widths than that of the antenna module 200 according to the second embodiment, the antenna module 100 has VSWRs less than or equal to 2 in a broader frequency band. This is because: each antenna element in the antenna module 100 according to the first embodiment is asymmetric; the spacing between the elements is wide; and consequently, negative influence due to the coupling between the antenna elements becomes smaller. Smaller negative influence due to the coupling between both elements provides an effect of maintaining directionalities thereof at frontal directions.

Also, as shown by the line 23, the example, in which each antenna element is symmetric and the widths of the antenna element are $\alpha\lambda/4$, has VSWRs around 2 in a band of between 4 GHz and 10 GHz. Therefore, the antenna module according to this example operates well in the above band.

Taking into account the above, from an aspect of widening the spacing between the antenna elements so that a close spacing does not lead to the coupling of the both element, a preferable spacing between antenna elements may be in a range between $\alpha\lambda/4$ and $\alpha\lambda/3$.

Also, as shown by the line 22, the example, in which each antenna element is symmetric and the width of each antenna element is $\alpha\lambda/6$, has VSWRs around 3 in a band of between 4 GHz and 10 GHz. Therefore, it is possible to use the antenna module according to this example in this band. Therefore, when the width of the antenna element is greater than or equal to $\alpha\lambda/6$, it is possible to broaden a bandwidth of the antenna module.

As shown by the line 21, the example, in which each antenna element is symmetric and has the width of $\alpha\lambda/60$, performs well in a band only around 4 GHz. In this example, it is possible to achieve a polarization diversity.

Modified Embodiment

While the embodiments according to the present invention have been described above, the invention is not limited to the above-described embodiments. The present invention covers various modification that can realize functions associated with each element according to the present invention.

For example, in each above-described embodiment, the portion of the perimeter of the ground facing the two antenna elements has a circular arc shape. However, in order for the ground element to have such a shape that the ground element curves so as to being away from the antenna elements, it is not necessary for the perimeter to have a circular arc shape.

For example, a portion of the perimeter of the ground element located adjacent to the two antenna element may have such a polygonal shape that segments connect multiple points on a circular arc. More specifically, it is sufficient for the perimeter of the ground element to be configured in such a manner that: a spacing between the perimeter and the first (or second) antenna element increases in a direction away from the second (or first) antenna element as a function of increasing distance from the first (or second) feeding point; and a spacing between the perimeter and the second (or first) antenna element increases in a direction away from the first (second) antenna element as a function of increasing distance from the second (first) feeding point.

Figure 5:
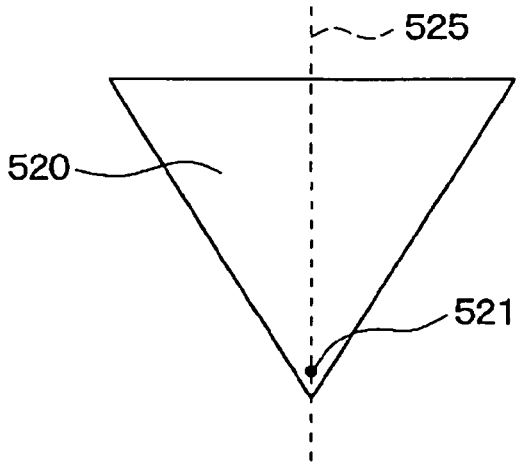
FIG. 5 is a schematic plan view illustrating an antenna module according to an example of a modified embodiment.
Figure 6:
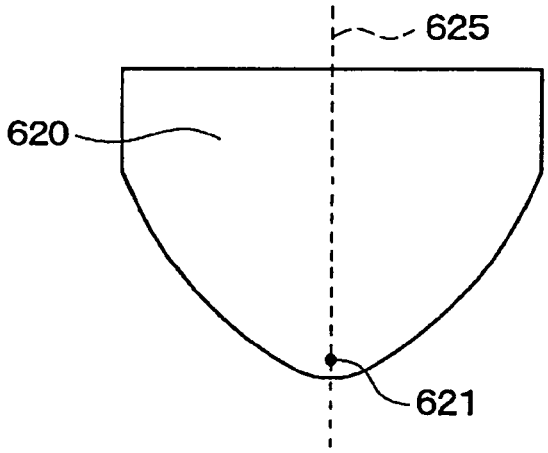
FIG. 6 is a schematic plan view illustrating an antenna module according to another example of the modified embodiment.
Figure 7:
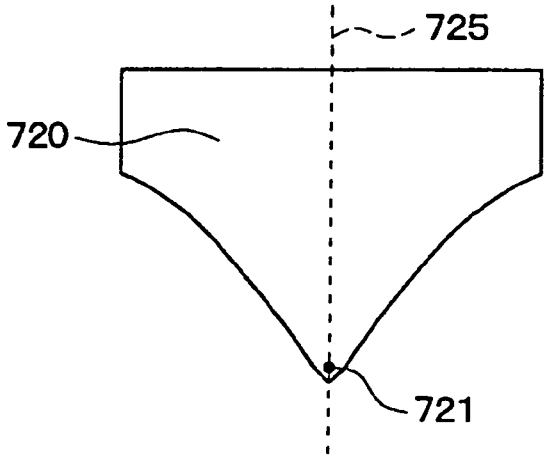
FIG. 7 is a schematic plan view illustrating an antenna module according to another example of the modified embodiment.

Although the antenna element has a home plate shape in the first to third embodiments, the shape of the antenna element is not limited to the above shape. For example, an antenna module may include an antenna element 520 having a triangular shape, as shown in FIG. 5. Alternatively, as shown in FIGS. 6, 7, a tapered portion of an antenna module may have curving sides. Here, points 521, 621, 721, respectively, represent feeding points, and lines 521, 621, 721, respectively, extend from the feeding points.

In addition, in the above-described embodiments, directions of the antenna elements disposed on the substrate are determined so that the polarization directions associated with the antenna elements are orthogonal to each other. However, to provide a polarization diversity, an angle between the polarization directions associated with the two antenna element may not be necessarily 90-degree. When the angle between the polarization directions associated with the two antenna element is greater than 0-degree, it may be possible to provide a polarization diversity.

In addition, in connection with the above-described embodiments, a width of the first antenna element in a direction perpendicular to the first polarization direction may be greater than ⅔ multiplied by a width in the first polarization direction, and a width of the second antenna element in a direction perpendicular to the second polarization direction may be greater than a width in the second polarization direction. The above configuration may enable to broaden a bandwidth of the antenna module.

Moreover, in connection with the above-described embodiments, a width of the first antenna element in the direction perpendicular to the first polarization direction may be greater than a width in the first polarization direction, and a width of the second antenna element in the direction perpendicular to the second polarization direction may be greater than a width in the second polarization direction. The above configuration may enable to further broaden a bandwidth of the antenna module.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An antenna module comprising:

a substrate;

a ground element disposed on the substrate;

a first antenna element disposed on the substrate and configured to transmit a radio wave having a first polarization direction;

a second antenna element disposed on the substrate and configured to transmit a radio wave having a second polarization direction;

a first feeding point disposed in the first antenna element on a ground element side; and a second feeding point disposed in the second antenna element on a ground element side, wherein:

the first polarization direction is nonparallel to the second polarization direction;

the ground element is configured so that a spacing between a perimeter of the ground element and the first antenna element has a minimum located proximal to the first feeding point and the spacing increases in a direction away from the second antenna element; and the ground element is configured so that a spacing between the perimeter of the ground element and the second antenna element has a minimum located proximal to the second feeding point and the spacing increases in a direction away from the first antenna element.

2. The antenna module according to claim 1, wherein:

a portion of the perimeter of the ground element is defined as a first perimeter portion, which is located adjacent to the first and second feeding points; and the ground element is configured so that the first perimeter portion has a substantially circular arc shape.

3. The antenna module according to claim 1, wherein:

a portion of the perimeter of the ground element is defined as a second perimeter portion, which is located adjacent to the first and second feeding points; and the ground element is configured so that the second perimeter portion is a part of a perimeter of a polygon substantially inscribed in a given circle.

4. The antenna module according to claim 1, wherein:

the ground element is configured so that a shape of the ground element is substantially line-symmetric about a first symmetry axis;

the first and second antenna elements are configured so that a shape of the first antenna element and a shape of the second antenna element are line-symmetric to each other with respect to the first symmetry axis; and the first and second feeding points are arranged so that a position of the first feeding point and a position of the second feeding point are line-symmetric to each other with respect to the first symmetry axis.

5. The antenna element according to claim 4, wherein:

the first antenna element includes a first tapered portion;

the first feeding point is disposed around a vertex of the first tapered portion;

the first tapered portion has a first width in a direction perpendicular to the first polarization direction;

the first tapered portion is configured so that the first width increases with distance from the first feeding point in the first polarization direction;

the second antenna element includes a second tapered portion;

the second feeding point is disposed around a vertex of the second tapered portion;

the second tapered portion has a second width in a direction perpendicular to the second polarization direction; and the second tapered portion is configured so that the second width increases with distance from the second feeding point in the second polarization direction.

6. The antenna module according to claim 5, wherein:

the first and second tapered portions are configured so that a spacing between the first and second tapered portions increases as in a direction away from the ground element.

7. The antenna module according to claim 6, wherein:

a line passing through the first feeding point and parallel to the first polarization direction is defined as a partition line;

the first tapered portion has a first tapered portion subelement and a second tapered portion subelement, which are partitioned by the partition line;

the first tapered portion subelement is located closer to the second tapered portion than the second tapered portion subelement; and the first tapered portion is configured so that an area of the first tapered portion subelement is smaller than an area of the second tapered portion subelement.

8. The antenna module according to claim 1, wherein:

a width of the first antenna element in a direction perpendicular to the first polarization direction is larger than two third of a width of the first antenna element in the first polarization direction; and a width of the second antenna element in a direction perpendicular to the second polarization direction is larger than two thirds of a width of the second antenna element in the second polarization direction.

9. The antenna module according to claim 8, wherein:

the width of the first antenna element in the direction perpendicular to the first polarization direction is larger than the width of the first antenna element in the first polarization direction; and the width of the second antenna element in the direction perpendicular to the second polarization direction is larger than the width of the second antenna element in the second polarization direction.

10. The antenna module according to claim 4, wherein:

a line passing through the first feeding point and parallel to the first polarization direction is defined as a partition line;

the first tapered portion has a first tapered portion subelement and a second tapered portion subelement, which are partitioned by the portion line; and the first tapered portion is configured so that a shape of the first tapered portion subelement and a shape of the second tapered portion subelement are line-symmetric to each other with respect to the partition line.

* * * * *

UNITED STATES PATENT AND TRADEMARK OFFICE

CERTIFICATE OF CORRECTION

PATENT NO. : 7,688,266 B2
APPLICATION NO. : 12/080265
DATED : April 1, 2008
INVENTOR(S) : Kiyokazu Akiyama et al.

It is certified that error appears in the above-identified patent and that said Letters Patent is hereby corrected as shown below:

In the Title Page:

(73), Assignee: "Denso Corporation, Kariya (JP)" should be

-- Nippon Soken, Inc., Nishio-city (JP);

DENSO CORPORATION, Kariya-city (JP) --;

Signed and Sealed this
Sixteenth Day of October, 2012

David J. Kappos

David J. Kappos
*Director of the United States Patent and Trademark Office*